United States Patent [19]

Koziol et al.

[11] 4,138,510

[45] Feb. 6, 1979

[54] METAL ANODE FOR ELECTROCHEMICAL PROCESSING AND METHOD OF MAKING SAME

[75] Inventors: Konrad Koziol; Hans-Carl Rathjen, both of Rothenbach, Pegnitz; Karl-Heinz Sieberer, Zirndorf near Nuremberg, all of Fed. Rep. of Germany

[73] Assignee: Firma C. Conradty, Fed. Rep. of Germany

[21] Appl. No.: 580,222

[22] Filed: May 23, 1975

Related U.S. Application Data

[60] Division of Ser. No. 401,542, Sep. 27, 1973, Pat. No. 3,926,773, which is a continuation of Ser. No. 163,256, Jul. 16, 1971, abandoned.

[51] Int. Cl.[2] ..... C25B 11/02; C25B 11/08

[52] U.S. Cl. ..... 427/124; 427/115; 427/123; 427/125; 427/126; 427/376 G; 427/376 H; 427/380; 427/383 C; 427/404; 427/405; 427/419 A; 427/435; 427/436

[58] Field of Search ..... 204/290 F; 427/124, 427/125, 126, 380, 383 C, 435, 436, 229, 226, 115, 123, 376 G, 376 H, 404, 405, 419 A

[56] References Cited

U.S. PATENT DOCUMENTS

| | | | |
|---|---|---|---|
| 3,171,757 | 3/1965 | Duddy | 427/115 |
| 3,497,425 | 2/1970 | Cotton et al. | 427/124 |
| 3,503,799 | 3/1970 | Aoki et al. | 427/125 |
| 3,654,121 | 4/1972 | Keith et al. | 204/290 F |
| 3,663,414 | 5/1972 | Martinsons et al. | 427/226 |
| 3,668,005 | 6/1972 | Sluse et al. | 427/126 |
| 3,787,244 | 1/1974 | Schulmeister | 427/115 |
| 3,926,773 | 12/1975 | Koziol et al. | 204/290 F |
| 3,977,959 | 8/1976 | Habermann | 204/290 F |
| 4,007,107 | 2/1977 | Johnson | 204/290 F |

*Primary Examiner*—Michael F. Esposito
*Attorney, Agent, or Firm*—McGlew and Tuttle

[57] ABSTRACT

A valve metal anode, for electrolytical processes, having an electron-active covering layer, is prepared by anchoring electron-activating substances, counteracting passivation of the anode, in a sintered porous carrier layer of valve metal. The carrier layer which is sintered onto the cleaned valve metal base may consist of a powder of the same metal or of the crystallographically similar metal. The infusion of the active substances into the carrier layer can be accomplished by impregnating and drying or baking the active substances, by precipitating them from the vapor phase, galvanically, or from the gaseous phase. The active substances may also be ingredients of the sinter mixture.

7 Claims, 4 Drawing Figures

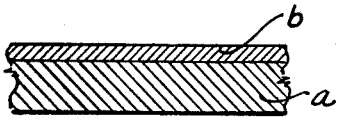
Fig-1-
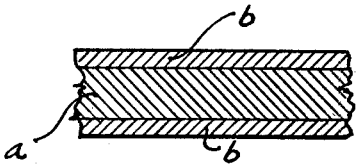
-Fig-2-
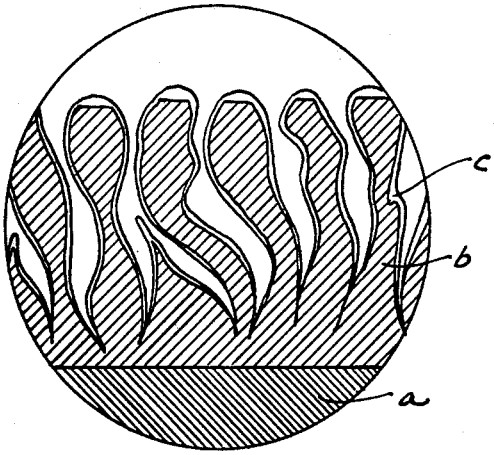
-Fig-3-
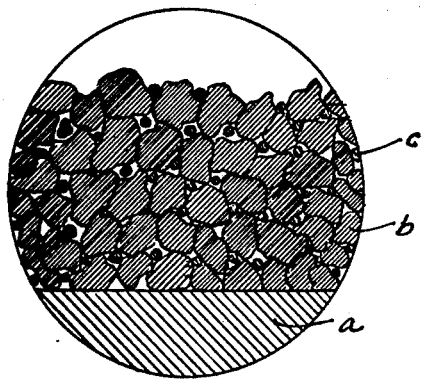
-Fig-4-

METAL ANODE FOR ELECTROCHEMICAL PROCESSING AND METHOD OF MAKING SAME

CROSS REFERENCE TO RELATED APPLICATION

This application is a division of application Ser. No. 401,542, filed Sept. 27, 1973 as a continuation of application Ser. No. 163,256, filed July 16, 1971, now abandoned, and now U.S. Pat. No. 3,926,773, issued Dec. 16, 1975.

FIELD OF THE INVENTION

This invention relates to methods of making anodes for electrolytical processes and, more particularly, to an improved method of making a valve metal anode having an electron-active covering layer.

BACKGROUND OF THE INVENTION

The high state of development of new large electrolytic cells, reflected above all in low cell voltages, high current and energy yields, ease of operation and operating safety of electrolysis plants, is due to a number of measures and improvements relating, not in the least, to the electrode.

Technical anode materials must meet a number of specifications including, among others, the corrosion resistance of the anode material and the progress of the anode process with a sufficiently high speed and the least possible excess voltage. Anode materials used heretofore on a large industrial scale meet these constantly increasing demands only partially. For example, there is a certain amount of unavoidable burning off when graphite anodes are used. In modern large cells, this requires expensive equipment for the maintenance of a constant spacing between the anode and the cathode, in addition to which a relatively high expense is necessary for brine cleaning.

In addition to graphite anodes, anodes of precious metal, such as platinum, metals of the platinum group, and their alloys also have been used. Such anodes always have the disadvantage of very high investment costs and of a relatively heavy wear of noble or precious metal. Anodes of platinized titanium have recently become known, mainly for price reasons, but they have always failed in the sector of Hg electrolysis for reasons of their great amalgam sensitivity.

The expression "valve metals" has lately become very popular for the group of metals including titanium, tantalum, niobium, zirconium, tungsten and molybdenum. It is known that these valve metals passivate very quickly when used in aqueous solutions, due to the development of a dense cover layer of an oxidic nature, thereby becoming extremely corrosion-resistant in many electrolyes. However, the passive layers of these metals have no electron conductivity in the electric potential ranges here in question, so that very high field densities occur in the layers. Above a certain potential, called "breakthrough potential", this leads to the destruction of the passivating layers. Despite the fact that these metals have great corrosion resistance, no anode process can be carried out with these metals in the passive state. It is usually not noted that, even in the noble or precious metals, the Flade potential, which is the potential at which the metal passes over from the active to the passive state, is considerably more negative than the normal potential. Accordingly, at higher potentials the noble metals also are covered by passive layers in electrolytes. In platinum, a monomolecular oxygen-chemisorption layer on the metal surface will already lead to passivity. It is immaterial, for this passive layer mechanism, whether the cover layer of an oxidic nature is generated on the noble metal in the electrolyte or whether oxidic noble metal cover layers are applied prior to immersion in the electrolyte, as proposed for the dimensional stable anodes in DT-OS 18 14 567 (German patent application laid open for publicatin without examination). These passive layers on noble metal bases, in contrast to the passive layers of the valve metals, distinguish themselves by their good electron conductivity, thus permitting carrying out of the anode process.

It is obvious, however, that the anchoring of foreign substances to the carrier metal, such as cubic-face-centered platinum to titanium which, at the temperatures used, is most densely compacted hexagonally as a rule, is problematical. Also, the mechanical durability of oxide layers adhering to metal is unsatisfactory because, due to the difference in contractional behavior under rapid temperature changes, stresses will develop in the boundary area between the oxide and the metal, and these stresses cause the oxide to flake off, as is clearly demonstrated by specimens which have been oxidized for some time in air at elevated temperatures. As is known, this method of rapid temperature change is also employed frequently, in industry, for the removal of scale layers. This should also explain adequately the susceptibility of the anodes, according to DT-OS 18 14 567 (German patent application laid open for publicatin without examination), which are provided with ceramic semiconductor coatings, and in which the active cover layer, provided with a chlorine releasing catalyst rests on the bare or on the oxide layer covering the valve metal base.

SUMMARY OF THE INVENTION

The present invention is directed to a method of making a metal anode for electrolytical processes and, by way of example, its application to chlorine-alkali electrolysis will be described in some detail, although it should be understood that the anode may be used also in connection with many other electrolysis processes.

The invention is based on the problem of developing an anode in which the active substances, counteracting the passivation of the valve metal are (1) anchored better to the base, (2) connected electron-conductively with a by far larger metal conductor surface, (3) protrude deeply into the valve metal base and thus are enabled to withstand the intensive chemical, mechanical and errosive stresses in the electrolysis bath, and (4) are not required, due to this construction, to meet the strict demands of epitaxis and good electron conductivity, thereby largely obviating the limitations of selection.

In accordance with the invention, the problem is solved in a particularly advantageous manner by an electrode in which the active substances, counteracting passivation, are anchored in a porous carrier layer sintered onto the valve metal base. The carrier layer sintered onto the cleaned valve metal base may consist of a powder of the same metal, or of a crystallographically similar metal. The pretreatment of the valve metal base may be effected by any desired method, such as pickling, steam degreasing, rinsing, grinding, or the like. The size, shape and surface of the metal powder particles vary in accordance with the material and the production method. The application of the powder particles to the valve metal base may be accomplished by spraying, rolling, electro-depositing, brushing, and other suitable methods, prior to the sintering operation. To facilitate the application, prior to the sintering operation, binders or adhesives or both may be admixed with the powder. It is expedient to use, as powder, various valve metal powders such as titanium powder or tantalum powder, or a mixture of valve metal powders, or a valve metal alloy present in powder form.

An object of the invention is to provide an improved method of making a valve metal anode for electrochemical processes.

Another object of the invention is to provide such a method in which active substances, counteracting passivation, are anchored in a porous carrier layer sintered onto a valve metal base.

For an understanding of the principles of the invention, reference is made to the following description of typical embodiments thereof, as illustrated in the accompanying drawings.

BRIEF DESCRIPTION OF THE DRAWINGS

In the drawings:

FIGS. 1 and 2 are cross sectional views schematically illustrating the construction of anodes embodying the invention;

FIG. 3 is an enlarged sector of a covering layer illustrated in FIGS. 1 and 2; and FIG. 4 is an enlarged sector of a porous carrier layer with embedded active particles.

DESCRIPTION OF THE PREFERRED EMBODIMENTS

Referring to the drawings, the solid basic valve metal body of the anode is indicated at a, and the sintered, porous valve metal layer, which supports the active substances, is indicated at b, as shown in FIGS. 1 and 2. FIG. 3 represents an enlarged sector of the layer designated b in FIGS. 1 and 2, wherein the active substances, counteracting passivation, are indicated at c. In FIG. 4, which is an enlarged sector of the porous valve metal powder carrier layer illustrated at b in FIGS. 1 and 2, the embedded active particles are indicated at c.

Titanium has the special characteristic of being obtainable in purer form as a powder than in the molten state. Nevertheless, depending upon the method of production and storage, the surface of commercial powders usually is covered with a film of adsorbed gases. When stored in air, oxide films will usually form, while storing in a nitrogen atmosphere will cause a partial nitration. Thus, a reducing pretreatment may become necessary before the sintering operation. However, in certain cases, the powders also may be used for sintering without a pretreatment. Tests carried out prove that the most uniform, most stable and yet porous sintered layer is obtained with powders having a rather uniform particle size of approximately 30 mu. The particles were of almost spherical shape, so that the size stated relates to the diameter of the particles.

In some cases, in which a slighter greater porosity is desired, it is recommended to use fillers, the majority of which will readily evaporate during the sintering operation, or which are removed by thermal disintegration. The following ammonium salts, such as ammonium perchlorate, ammonium chromate, ammonium sulfate, and resin diluted with alcohol, are listed, merely by way of example, without necessarily limiting the range of usable agents.

In order to avoid oxidation of the valve metal powder during the sintering process, the latter is carried out either in a vacuum between 1 and $5 \times 10^{-7}$ Torr, or in a definite gas atmosphere, such as argon. The heating rate is determined either by the quality of the vacuum or by thermally disintegrating substances limiting the heating rate in order to avoid damage to the sintered layer. The sintering temperature varies between 800° C. and 2800° C., depending upon the metal powder and the base metal, with the heating periods ranging between several hours and ¼ hour, again depending upon the temperature.

The infusion of the active substances, counteracting passivation, can be effected by impregnating and drying, and baking them in, or by both, by precipitating them from the vapor phase, galvanically, or by precipitating them from the gaseous phase. Adding a wetting agent frequently results in a further improvement. The active substances may also be ingredients of the sinter mixture before sintering.

All substances of sufficient corrosion resistance during electrolysis, and possessing good electron conductivity in the potential ranges used, so that an anode process can be carried out, are suitable as active substances. These are all metals and oxides of the platinum metal group, intermediate and mixed oxides of precious and ignoble metals or both, or oxides of ignoble metals alone, which meet the requirements set forth above. Surprisingly, it has been found that, with this construction, even conductive materials of a base or non-precious character lead to excellent results. Thus, the widely held opinion that the active layer always must contain noble precious metal or noble precious metal compounds, in order to remain effective, is now refuted for the first time.

By the term ignoble metals, as used herein, is meant any metals or the like other than the so-called "noble metals" or "precious metals", such as platinum, gold, silver and the like. The term "ignoble metals" includes such as metals as lead, manganese, iron, cobalt, nickel and chromium, and is equivalent to "non-precious metals".

Desired active substances need not yet be present in oxidic form during the infusion, but may be produced in the sintered layer during or after the heat treatment and/or the sintering operation, by an additional after treatment.

As a result of this treatment there is obtained, on a valve metal base, a compound material, i.e. a metal/metal or a metal/ceramic combination. This is a mechanically strong, yet porous, crystallographically identical, well adherent valve metal carrier layer containing the active substances in well anchored form. This layer, which in part displays cermet characteristics, is characterized in that the active substances are built into a carrier skeleton having the same crystalline structure as the base valve metal, thus forming one unit with the base valve metal. Therefore, the electrical conductivity through this activated carrier layer is primarily of a metallic nature. Although sintered layers have a greater electrical resistance than solid parts of the same metal, the basic valve metal body can be dispensed with if the mechanical strength is adequate and the sintered body alone may be used, this sintered body containing the active substances counteracting passivation. In addition, the sintered layer permeating the active substances protects them from mechanical and, to a certain extent, also chemical attacks. As an additional advantage, a considerable lesser amalgam sensitivity is attained.

This represents an unequivocal improvement over the conventional platinized titanium anodes in which, in case of a short circuit with the mercury cathode, a part of the platinum layer, which is kept very thin for price reasons, is removed by amalgam formation, thereby making the anode inactive after a short period of time. If, on the other hand, the platinum layer is accommodated within the sintered layer according to the invention, then, due to the great surface tension of the mercury, a contact between the mercury and the noble or precious metal is hardly possible and no wear due to amalgam formation need be anticipated.

It has hitherto been necessary for active layers applied to the anode to be of relatively great strength and thus to be resistant to mechanical stresses. This eliminated a number of materials for use in practice right from the start, although they would have been of interest from an electrical and economical standpoint. For example, cover layers on spinel bases could not be used technically until now on a valve metal base because the adhesion of the spinels to the bare or oxidized metal base is insufficient. This is also confirmed by a test in which a titanium sheet, coated with an iron-chrome spinel, was destroyed after an operating period of twenty-seven days in a laboratory cell at a current density of 1 $A/cm^2$, while the same spinel, infused into the sintered layer, resulted in an extension of the life span to roughly 250 days. Similar results were obtained with the oxides and oxide mixtures of base metals, including manganese, iron, cobalt, nickel and tungsten.

Due to the great porosity of the sintered layers and the greater anode surface area resulting therefrom, a lesser true anode current density than with conventional metal anodes is actually attained under the same load. This expresses itself in an additional voltage economy of several tenths volt.

The following examples are given solely by way of example, and not in a limiting sense:

EXAMPLE 1

A titanium sheet, whose dimensions are 100 × 100 × 1 mm, was pickled for 30 minutes in a 20 percent by weight boiling hydrochloric acid, washed with water, and rinsed with propanol. A mixture of titanium powder, polyglycol 6000 and hexanol was sprayed on the thus prepared sheet by means of a compressed air operated spray gun. After a 20 minutes drying period at 120° C. in a drying oven, the titanium powder coating was sintered on in an induction furnace at a heating rate of 300° C./h and an end temperature of 1100° C.

The thus produced basic body was soaked in a 1-molar ruthenium-chloride solution, to which was added some wetting agent known as "Erkantol". This was followed by a heat treatment 450° C. for 30 minutes. The process was repeated three times in an identical manner.

The anode thus produced, as compared to an anode coated with the same solution in a known manner, namely without a sintered coating, has a much greater active surface, resulting, under the same load, in a small true anode current density and, consequently, in a lower cell voltage. In addition, the anode embodying the invention is also considerably more amalgam-proof and short-circuit-proof.

EXAMPLE 2

A titanium rod 400 mm long and 3 mm in diameter was pickled for 30 minutes in a boiling 20 percent by weight hydrochloric acid, washed with water and rinsed with propanol. By means of a carbon mold, and by sintering in a tubular furnace at 1200° C., a titanium sinter coat 1 mm thick was applied to the thus prepared rod. The sintered rod was repeatedly impregnated with a solution containing $Mn(NO_3)_2$ and $AgNO_3$ in a 1:1 ratio, and dried in air. For activation, the rod was left for five minutes in the vapor chamber of a boiling 20 percent by weight hydrochloric acid. Finally, there followed a baking operation lasting from 40 minutes to 5 minutes at temperatures between 200° and 450° C.

EXAMPLE 3

A fine-mesh, commercially platinized titanium mesh of expanded metal, was pulled through a titanium-tantalum powder mixture made pasty by a higher alcohol, and sintered in a continuous furnace. Due to the higher melting point of the noble metal, sintering occurred mainly at the areas of the basic valve metal body which are free of noble metals.

The greatest possible protection of the platinum layer is attained by this sintered valve metal coating.

From the foregoing, it will be clear that the invention opens up, to the electrochemical industry, a multiplicity of the most varied electrode materials, which are far superior to the electrode materials use hitherto as regards price, durability and economy in operation.

The theories mentioned above are intended only to be of an explanatory nature and to describe the operating mode of making the electrode according to the method of the invention, and are by no means to be considered as binding or limiting the application of the electrode in any way.

While specific embodiments of the invention have been shown and described in detail to illustrate the application of the principles of the invention, it will be understood that the invention may be embodied otherwise without departing from such principles.

What is claimed is:

1. A method of making a valve metal anode, for electrolytical processes, having an electron-active cover layer, of sufficient corrosion resistance during electrolysis, and possessing good electron conductivity in the potential ranges used, in which active substances, counteracting passivation, are anchored, the active substances being selected from the group consisting of metals and oxides of the platinum metal group, mixed oxides of precious and ignoble metals and both, and oxides of ignoble metals alone, comprising the steps of providing, on a solid core of valve metal, a carrier layer of valve metal powder; sintering said valve metal powder in a non-oxidizing atmosphere; and impregnating the electron-active substances into the sintered, porous carrier layer.

2. A method, as claimed in claim 1, in which the impregnated electron-active substances are dried.

3. A method, as claimed in claim 1, in which the impregnated electron-active substances are baked.

4. A method, as claimed in claim 1, in which the electron-active substances additionally contain a wetting agent.

5. A method of making a valve metal anode, for electrolytical processes, having an electron-active cover layer, of sufficient corrosion resistance during electrolysis, and possessing good electron conductivity in the potential ranges used, in which active substances, counteracting passivation, are anchored, the active substances being selected from the group consisting of metals and oxides of the platinum metal group, mixed oxides of precious and ignoble metals and both, and oxides of ignoble metals alone, comprising the steps of providing, on a solid core of valve metal, a carrier layer of valve metal powder; sintering said valve metal powder in a non-oxidizing atmosphere; and thereafter vapor depositing the electron-active substances into the sintered porous carrier layer.

6. A method, as claimed in claim 5, in which the electron-active substances are precipitated into the carrier layer from the gaseous phase.

7. A method, as claimed in claim 5, in which the electron-active substances are precipitated into the carrier layer from the vapor phase.

* * * * *